United States Patent [19]

Theile et al.

[11] 4,183,820

[45] Jan. 15, 1980

[54] USE OF DEMULSIFYING MIXTURES FOR BREAKING PETROLEUM EMULSIONS

[75] Inventors: Heinz Theile, Sulzbach; Hermann Hoffmann, Kelkheim; Gerd Rossmy, Haltern-Lavesum; Götz Koerner, Essen; Pete Zäske, Essen-Bredeney, all of Fed. Rep. of Germany

[73] Assignee: Th. Goldschmidt AG, Fed. Rep. of Germany

[21] Appl. No.: 932,816

[22] Filed: Aug. 10, 1978

Related U.S. Application Data

[63] Continuation of Ser. No. 664,211, Mar. 5, 1976, abandoned, which is a continuation of Ser. No. 404,794, Oct. 9, 1973, abandoned.

[30] Foreign Application Priority Data

Oct. 18, 1972 [DE] Fed. Rep. of Germany ..... 2250920

[51] Int. Cl.[2] ..... B01D 17/04

[52] U.S. Cl. ..... 252/342; 252/343; 252/345; 252/358

[58] Field of Search ..... 252/358, 321, 345, 342, 252/343; 260/29.2 M, 29.2 EP

[56] References Cited

U.S. PATENT DOCUMENTS

| | | | |
|---|---|---|---|
| 2,499,370 | 3/1950 | DeGroote et al. | 252/331 |
| 2,524,889 | 10/1950 | DeGroote et al. | 252/331 |
| 2,574,543 | 11/1951 | DeGroote et al. | 252/331 |
| 3,677,962 | 7/1972 | Koerner et al. | 252/345 |

FOREIGN PATENT DOCUMENTS 1069615 7/1951 France .

*Primary Examiner*—Benjamin R. Padgett
*Assistant Examiner*—E. Suzanne Parr
*Attorney, Agent, or Firm*—James E. Bryan

[57] ABSTRACT

This invention relates to an emulsion-breaking composition comprising about 70 to 99.8% by weight of at least one silicon-free demulsifier, and about 0.2 to 30% by weight of a mixed polyoxyalkylene-polysiloxane block polymerizate, the polyoxyalkylene blocks of which have a molecular weight of about 500 to 4000 and are composed of polyoxyethylene and polyoxypropylene blocks in a weight ratio of 40 to 60 to 100:0, and the polysiloxane blocks of which contain 3 to 50 silicon atoms per block. The invention also includes a process for breaking emulsions using the novel emulsion-breaking composition.

15 Claims, No Drawings

USE OF DEMULSIFYING MIXTURES FOR BREAKING PETROLEUM EMULSIONS

This is a continuation of application Ser. No. 664,211, filed Mar. 5, 1976 now abandoned, in turn a continuation of Ser. No. 404,794, filed 10/9/73, 73, and now abandoned.

The present invention relates to the use of particular compound mixtures for breaking petroleum emulsions.

A large portion of crude petroleum contains specific amounts of emulsified water, or aqueous solutions of sodium chloride, or also of other salts, mainly in the form of W/O emulsions. This water is separated, in practice, by the addition of very minor amounts of demulsifying substances. Demulsifying agents already have been proposed in the art in large numbers. The reason for this is that the various mineral oils have a different composition, and demulsifiers which are suitable for breaking down emulsions of petroleum of one origin are frequently less suitable for petroleum emulsions of a different type. The known demulsifiers act therefore more or less markedly specifically upon individual petroleum types.

As demulsifying agents, alkyl sulfates and alkyl aryl sulfonates as well as petroleum sulfonates in the form of amine salts already have been proposed. Furthermore, addition products of ethylene oxide to suitable compounds with active hydrogen atoms, such as for example alkyl phenols, castor oil, fatty acids, fatty alcohols, and aldehyde resins, have also been mentioned. Corresponding statements are found, for example, in the book "Oberflächenaktive Anlagerungsprodukte des Äthylenoxids" (Surface-Active Addition Products of Ethylene Oxide), by N. Schönfeld, Wissenschaftliche Verlagsgesellschaft mbH (Scientific Publishing Company), Stuttgart, 1959, page 295.

Despite the large number of demulsifiers available on the market, it is not possible, however, to break all of the occurring petroleum/water emulsions rapidly, safely, reproducibly, and with small quantities of addition products.

The spectrum of the usable compounds has been expanded particularly due to the introduction of specific organic silicone compounds for breaking petroleum emulsions. Thus, specific mixed polyoxyalkylene-polysiloxane block polymerizates already have been proposed as demulsifiers in German Auslegeschrift No. 1,937,130. The widespread use of these very effective products is diminished, however, by the relatively high price thereof.

It is the object of the present invention to provide demulsifiers, particularly demulsifier mixtures, which are specific to petroleum types to the smallest possible extent, which cause an effective breaking of the petroleum emulsions when used in small quantities, and which have the advantages of the mixed polyoxyalkylene-polysiloxane block polymerizates.

It has been found surprisingly that certain mixtures of a specific group of mixed polyoxyalkylene-polysiloxane block polymerizates with silicon-free demulsifiers effectively solve the problem. In addition thereto, it was found that the mixtures used in accordance with the present invention are very rapidly distributed in the petroleum to be demulsified. This facilitates the mixing work and is probably also the cause that the mixtures used according to the present invention lead in many cases to an increase of the speed of the water separation, which represents a significant commercial advantage.

During the further treatment of the petroleum, primarily in refineries, there is frequently the formation of undesirable foam. The mixtures used according to the present invention have the additional advantage that, during the treating processes in the refineries, they act as defoamers, so that the use of expensive silicon defoamers can be eliminated.

The action of the mixtures used according to the present invention as demulsifiers indicates that the mixed polyoxyalkylene-polysiloxane block polymerizate components in these mixtures primarily have the role of bringing the demulsifying mixture rapidly to the interface of the W/O emulsion, which is rendered possible by virtue of the extremely rapid spreading capacity of the mixed polyoxyalkylene-polysiloxane block polymerizates used according to the present invention.

In the present invention, mixtures are used of 0.2 to 30% by weight, preferably 0.5 to 10% by weight, of mixed polyoxyalkylene-polysiloxane block polymerizates whose polyoxyalkylene blocks have in each case a molecular weight of 500 to 4000 and are composed of polyoxyethylene- and polyoxypropylene blocks in a weight ratio of 40:60 to 100:0, and whose polysiloxane blocks contain 3 to 50 silicon atoms per block; and 70 to 99.8% by weight, preferably 90 to 99.5% by weight, of conventional silicon-free demulsifiers used for breaking petroleum emulsions.

In the mixed polyoxyalkylene-polysiloxane block polymerizates used according to the present invention, those are preferred whose polyoxyalkylene blocks have a molecular weight of 1000 to 3000.

If the polyoxyalkylene blocks are composed of ethylene oxide and propylene oxide units, these preferably should be present in separate blocks and a series connection of several ethylene oxide and propylene oxide blocks is also possible.

When ethylene oxide and propylene oxide are added to water in a block, polyoxyalkylene diols are produced. If a monovalent alcohol, such as for example methanol, or other lower aliphatic alcohols, are used as the starting alcohol, polyoxyalkylene monools are obtained. It is possible, however, to use multivalent alcohols as starting alcohols, such as for example glycerine or sorbitol, in which case one obtains polyoxyalkylene glycols with three and/or six hydroxyl groups, respectively.

The polysiloxane blocks, which should have 3 to 50 silicon atoms per siloxane block, are as a rule linear or branched methylpolysiloxanes, but also suitable are those polysiloxanes which partially have, instead of methyl groups, other lower alkyl groups or aryl groups.

The polyoxyalkylene blocks may be linked with the polysiloxane blocks either via SiOC groups or via SiC groups with each other. The preparation of such compounds with SiOC groups have been described, for example, in German Pat. No. 1,012,602. The compounds may be prepared in a particularly simple manner according to U.S. Pat. No. 3,115,512. Compounds with SiC linkages are obtained, for example, when ethylene oxide and propylene oxide are added to starting alcohols which are olefinically unsaturated, and when these compounds are then reacted with polysiloxanes having SiH groups. Such processes have been described, for example, in German Auslegeschrift No. 1,220,615. In addition, there are a large number of other processes for preparing such compounds.

The mixed polyoxyalkylene-polysiloxane block polymerizates employed according to the present invention are liquid to wax-like solid substances which may be dispersed or dissolved in water. They therefore may be added to the petroleum emulsion to be broken either directly or in the form of concentrated solutions or dispersions. Good results also are obtained, however, when the demulsifiers are dissolved in organic solvents, such as, for example, toluene or methanol, and then added to the emulsions.

Examples of mixed block polymerizates used according to the present invention may be represented by the following formulae, wherein A represents a polyoxyalkylene block and B a polysiloxane block:

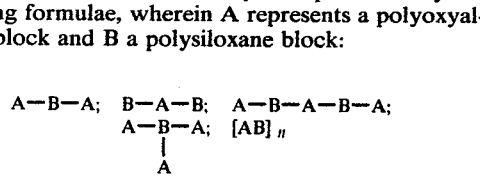

(n=any desired integer, preferably 3 to 50). Polyoxyalkylene blocks with OH and/or alkoxy residues at the end of the polymer chain are preferred end groups.

This listing is not exhaustive but only exemplary. The polyoxyalkylene block A may be represented by the formula:

$$[-O(C_nH_{2n}O)_m]_r Z$$

In this formula, n may have a value of 2.0 to 2.6. The value of m is determined by the requirement that the molecular weight of the polyoxyalkylene block is to be between 500 to 4000, preferably 1000 to 3000. Z is the alkyl- or aryl residue of the starting alcohol onto which ethylene oxide and propylene oxide have been added. The subscript r corresponds therein to the valence of the alcohol having the function of the starting alcohol. When for example, glycerine is employed as the starting alcohol, Z has the following structure:

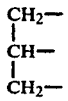

and r has a value of 3. If methanol is employed as the starting alcohol, $Z=CH_3$ and $r=1$. A polyalkylene glycol obtained by the addition of alkyleneoxide to $H_2O$ leads to a block with $Z=H$; r is here again $=1$.

In the structural diagram shown hereinabove, B signifies a polysiloxane block. This polysiloxane block may have, for example, the following structure:

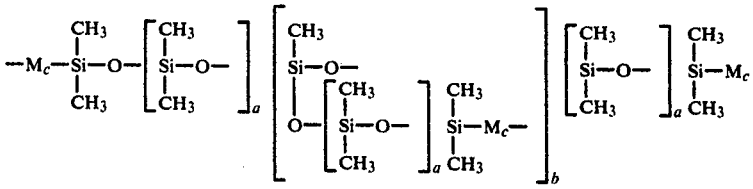

In this formula, M is an alkyl residue, and c is 0 or 1.

The subscripts a and b are variable, but are delimited by the condition that each polysiloxane block should contain at least 3, but not more than 50 silicon atoms.

A second example of the structure of the polysiloxane block B is represented in the following formula

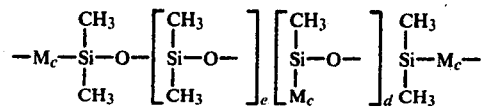

The substituents M and the index c have the above-identified meaning. The subscripts d and e are variable, but the sum thereof must be between 1 to 48. It is evident therefrom that d or e may have a value of 0.

A further example of the structure of the polysiloxane block B is represented by the following formula:

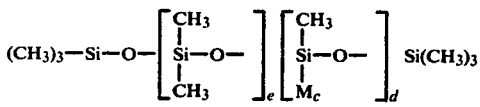

The symbols have the same meaning as in the previous formula but d must in this formula have at least the value of 1.

The linkage of the blocks A and B also may be effected, instead of via oxygen and/or a bivalent alkylene residue, through other bivalent residues, such as for example

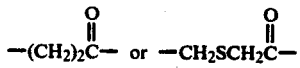

As a further linking group, the group

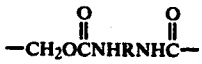

is another possibility, wherein R is a bivalent hydrocarbon residue which may be substituted, if desired, for example the 2,4-toluylene residue. The demulsifying effect of the mixed block polymerizates is not significantly influenced by the group linking the blocks.

Examples of mixed polyoxyalkylene-polysiloxane block polymerizates preferably used as those having the general formula $$X(AB)_nAX$$

wherein n=1 to 100, preferably 5 to 20, and

A is a polyoxyalkylene block having the general formula

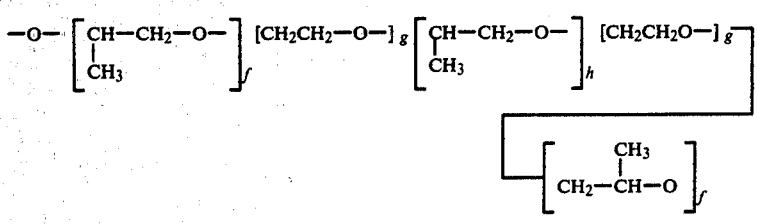

wherein f=0.5 to 3; g=6 to 12; h=8 to 13; g:h preferably 0.9:1.0; preferably: f=1.5; g=8 to 10; h=9.5 to 11.5, and X=a monovalent hydrocarbon residue or, preferably, H.

B is a polysiloxane block having the formula

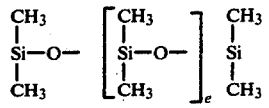

wherein: e=1 to 48, preferably 2 to 5, 9 to 12, and 20 to 23.

Further mixed polyoxyalkylene-polysiloxane block polymerizates preferably employed in the mixture of the invention are those having the general formula

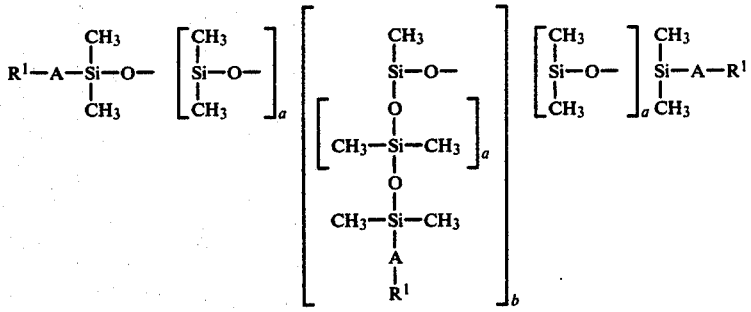

wherein:

a=0 to 20, b=0.1 to 10,

A=the polyoxyalkylene block, $R^1$=a monovalent hydrocarbon residue, for example alkyl with 1 to 18 C atoms or phenyl, preferably a=3 to 6, b=3 to 10,

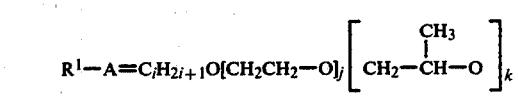

i=1 to 6; j=25 to 35, preferably 28.5, and k=5 to 9, preferably 7.5.

The subscripts n, m, r, a, b, c, d, e, f, g, h, i, j, and k used in the formulae represented hereinabove are mean values inasmuch as the mixed polyoxyalkylene-polysiloxane block polymerizates are polymer mixtures.

In addition, from among the polysiloxane blocks, those are preferred which have been brought, prior to linkage with the polyoxyalkylene blocks, into static balance with respect to their molecular weight distribution and the distribution of the various siloxane units. This term of "bringing into balance" is generally referred to as equilibrating.

The molecular weight of the mixed polyoxyalkylene-polysiloxane block polymerizates employed in the mixture of the invention preferably should be below 100,000.

From among the mixed polyoxyalkylene-polysiloxane block polymerizates whose siloxane block is linked with the polyoxyalkylene block via an SiOC connection, those compounds are used in which the linkage of the blocks is through a

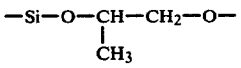

bridge.

Silicon-free demulsifiers used in the mixture of the invention are predominantly compounds of one of the following groups:

I. Reaction products of alkylene oxides with alkylphenolaldehyde resins. These are alkylphenol resins which are soluble in organic solvents and whose free hydroxyl groups are reacted with ethylene oxide and/or propylene oxide. The alkyl phenols required therefor are preferably monoalkyl phenols with straight-chain or branched alkyl groups having 4 to 18 carbon atoms in the o- or p-position, and smaller quantities of bis-alkylated phenols also may be present. For the conversion thereof into resins, formaldehyde or substances which yield formaldehyde under the conditions of the alkaline or acid condensation are used. Acetaldehyde and higher aldehydes also may be used, however, at the same time. The quantity of aldehyde employed during the condensation amounts to approximately 0.5 to 2.0 moles, preferably 0.9 to 1.1 moles, per mole of phenol. The reaction takes place in known manner in the presence of acid or alkaline catalysts with or without the addition of inert solvents. These alkyl phenol-formaldehyde resins are oxyalkylated according to known processes, and the quantity of the oxyalkylation agents employed depends, on the one hand, upon the length of the alkyl groups contained in the starting phenol resin, and on the other hand upon the properties of the crude oil to be demulsified. Generally, about 2 to 20 moles of epoxide per one hydroxyl equivalent are used.

Such demulsifiers have been described by way of example in U.S. Pat. Nos. 2,499,368; 2,499,370; 2,524,889; 2,560,333, and 2,574,543.

II. Block and mixed polymerizates of propylene oxide and ethylene oxide. These are special products obtained when approximately 30 to 100% by weight of ethylene oxide is added to propylene glycols with molecular weights of 500 to 5000, preferably 1500 to 3000, while increasing the final molecular weight. In this group of demulsifiers are furthermore products which are obtained by the addition of ethylene oxide and propylene oxide to compounds with 1 to 4 replaceable hydrogen atoms, such as, for example, alkanols and polyalcohols, mono- and polyamines, oxamines, and mono- and polycarboxylic acids. Compounds of this group are described, for example, in French Pat. No. 1,069,615, and in German Auslegeschrift No. 1,018,179.

III. Reaction products of the alkylene oxide polyadducts mentioned under II. and/or the oxyalkylated phenol-formaldehyde resins mentioned under I., with dicarboxylic acids, such as succinic acid, glutaric acid, sebacic acid, benzene dicarboxylic acids, and particularly adipic acid.

IIIa. Products obtained by cross-linking of the alkylene oxide polyadducts mentioned under II. with each other and/or with the oxyalkyllated alkylphenol-formaldehyde resins mentioned under I. Cross-linking agents in this case are compounds with 2 or 3 reactive groups which are suitable to react with the hydroxyl groups of the components to be cross-linked. Such cross-linking agents are, for example, diisocyanates, such as hexamethylene-diisocyanate, toluylene-2,4- and toluylene-2,6-diisocyanate, 1,4- and 1,5-naphthalene-diisocyanate, diphenylmethane-diisocyanate, 4,4-dicyclo-hexylmethane-diisocyanate, as well as phosphorus oxychloride and phosphorus trichloride. The quantity of the cross-linking agents used amounts, in bivalent cross-linking agents, to about 1/5 to ½ mole and, in trivalent cross-linking agents, to about 1/10 to ⅓ mole per hydroxyl equivalent of the products to be cross-linked.

IV. Physical mixtures of products of the groups I to III enumerated hereinabove.

In the following comparative examples, the effect of the demulsifier mixtures employed according to the present invention is illustrated.

EXAMPLE 1

Used in this test was a water-in-petroleum emulsion from a German field which is particularly difficult to demulsify. Employed as a comparison and simultaneously for mixing with specific mixed polyoxyalkylene-polysiloxane block polymerizates were two silicon-free demulsifiers which were relatively well suited for the demulsification of this water-in-petroleum emulsion. The silicon-free demulsifiers are designated A and B.

Demulsifier A is a cross-linked product of a polypropylene glycol-ethylene oxide polyadduct and a nonylphenol-formaldehyde resin reacted with ethylene oxide with the use of toluylene-diisocyanate as a cross-linking agent. The preparation of this product is described in Example 1 of German Pat. No. 1,642,825.

Demulsifier B is a mixture of one part by weight of a nonlyphenyl-formaldehyde resin to which were added 3 to 4 moles of ethylene oxide per phenolic hydroxyl group, and one part by weight of a polyalkylene oxy adduct with a polypropylene glycol nucleus and a molecular weight of 2000, to which ethylene oxide up to a content of 38% by weight in the final product was added and subsequently cross-linked with 0.4 mole of phosphorus oxychloride.

The petroleum sample was reacted at 50° C. with 15 ppm each of active material (demulsifiers and/or demulsifier mixtures). The addition of the demulsifiers took place therein from a 1% solution in a 1:1 mixture of toluene and methanol. After the addition, shaking was effected 200 times. The speed of the water separation is shown in the following table 1.

Table 1

| Product | $H_2O$ separation, in %, after | | | | |
|---|---|---|---|---|---|
| | 10' | 30' | 60' | 120' | 180' |
| 15 ppm demulsifier A | 55 | 64 | 70 | 72 | 73 |
| 15 ppm demulsifier B | 49 | 62 | 68 | 69 | 72 |
| 12 ppm demulsifier A + 3 ppm mixed polyoxyalkylene-polysiloxane block (+) polymerizate C | 69 | 81 | 86 | 92 | 95 |
| 12 ppm demulsifier B + 3 ppm mixed polyoxyalkylene-polysiloxane block (+) polymerizate C | 63 | 75 | 90 | 90 | 95 |

(+) The mixed polyoxyalkylene-polysiloxane block polymerizate C was a product having the formula:

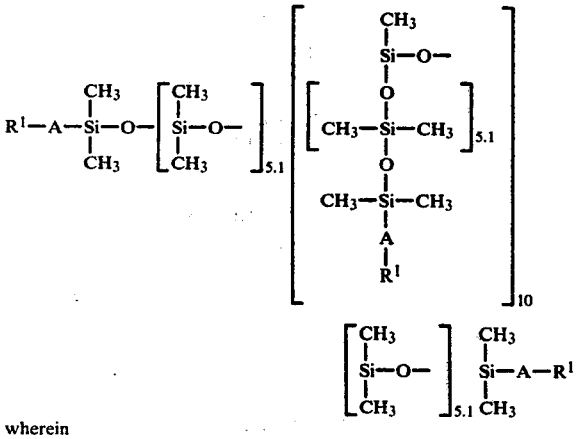

wherein $R^1—A = n\text{-}C_4H_9O—(CH_2CH_2O)_{28.4}—\left[CH_2—\underset{\underset{CH_3}{|}}{CH}—O—\right]_{7.2}$ and the block distribution was such that 2 moles of propylene oxide had been added on at the end position; the remaining propylene oxide was statistically distributed in the polyoxyalkylene block.

The sole use of 3 ppm of the mixed polyoxyalkylene-polysiloxane block polymerizate C produced almost no measurable water separation, which was, however, not surprising in view of the small amount, particularly for laboratory tests.

EXAMPLE 2

A water-in-petroleum emulsion, also originating from a German field, which was even more difficult to demulsify was chosen in this example in order to show the superior effect of the mixtures used according to the present invention. Employed here were again in each case a total of 15 ppm of demulsifier active material. The results obtained are compiled in Table 2, below.

Table 2

| Product | | $H_2O$ separation, in %, after 180 minutes |
|---|---|---|
| demulsifier A | | 38 |
| 7.5 ppm demulsifier A + 7.5 ppm mixed polyoxyalkylene-polysiloxane block polymerizate D | +) | 46 |
| 7.5 ppm demulsifier A + 7.5 ppm mixed polyoxyalkylene-polysiloxane block polymerizate E | +) | 52 |
| 7.5 ppm demulsifier A + 7.5 ppm mixed polyoxyalkylene-polysiloxane block polymerizate F | +) | 63 |

+) The polyoxyalkylene-polysiloxane block polymerizate D, E, and F corresponded to the formula $HA(BA)_{10}H$, wherein

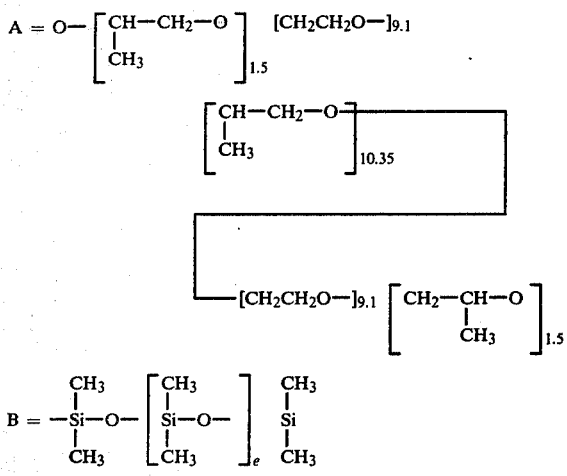

and e in the mixed polyoxyalkylene-polysiloxane block polymerizate D had a value of 2, in the mixed polyoxyalkylene-polysiloxane block polymerizate E a value of 12.74, and in the mixed polyoxyalkylene-polysiloxane block polymerizate F a value of 22.5.

Here again, the sole use of in each case 7.5 ppm of the three different mixed polyoxyalkylene-polysiloxane block polymerizates produced only a moderate water separation.

EXAMPLE 3

On a wet oil from the area between the rivers Weser and Ems, Germany, with a water content of 58%, the water separations were measured which were obtained in each case with the use of 20 ppm of one of the emulsion-splitting agents indicated below:

(a) Demulsifier G (nonyl phenol-formaldehyde resin which was reacted first with 10 moles of propylene oxide per phenolic OH group, and thereafter with 4 moles of ethylene oxide per phenolic OH group).

(b) A mixture of 97% by weight of demulsifier G and 3% by weight of the mixed polyoxyalkylene-polysiloxane block polymerizate D.

(c) A mixture of 90% by weight of demulsifier G and 10% by weight of the mixed polyoxyalkylene-polysiloxane block polymerizate D.

The separated water quantities, in % of the water originally contained in the wet oil, are compiled in the following table:

Table

| Splitting agent | Water separations, in % of the water still present, after 10′ | 30′ | 60′ | 120′ | 180′ |
|---|---|---|---|---|---|
| (a) | 45 | 55 | 59 | 62 | 62 |
| (b) | 69 | 73 | 73 | 76 | 80 |
| (c) | 69 | 76 | 80 | 80 | 83 |

The foregoing results show the advantageous action of the mixed polyoxyalkylene-polysiloxane block polymerizate by the quantity of water separated.

EXAMPLE 4

In an oil field in the East Hannover, Germany, area, the procedure was carried out, without a significant supply of heat, with the use of an emulsion-splitting agent whose active substance contained 1 part by weight of a block polymerizate with a nucleus of polypropylene oxide having a molecular weight of 1800 and a proportion of 45% by weight of ethylene oxide in the final product, and 2 parts by weight of demulsifier A. When using 35 ppm of the emulsion-splitting agent, a good water separation was obtained corresponding to mean salt values in the final product of 150 ppm. when the amount of emulsion-splitting agent was reduced to 20 ppm, the residual salinity in the final product increased to 500 ppm.

When this test was repeated with the same emulsion-splitting agent to which there had been added, however, 2.5% by weight of mixed polyoxyalkylene-polysiloxane block polymerizate D, mean salt values of 100 ppm were obtained for added amounts of 20 to 40 ppm.

EXAMPLE 5

In an oil field between the rivers Weser and Elbe, Germany, the following clarifying results were obtained, with the use of different emulsion-splitting agents, for a wet oil with a 10% by weight water content:

(a) Demulsifier H (a block polymerizate with a polypropylene glycol nucleus having a molecular weight of 2000 and an ethylene oxide content of 38% by weight in the final product).

(b) A mixture of 90% by weight of demulsifier H and 10% by weight of the mixed polyoxyalkylene-polysiloxane block polymerizate D.

(c) Demulsifier A (see Example 1).

(d) A mixture of 90% by weight of demulsifier A and 10% by weight of the mixed polyoxyalkylene-polysiloxane block polymerizate D.

The residual water and residual salt contents obtained after sedimentation are compiled in the following table:

Table

| Splitting Agent | | Residual Water (% by weight) | Salt Content (ppm) |
|---|---|---|---|
| (a) | 30 ppm | 0.7–0.8 | 800–900 |
| (b) | 30 ppm | 0.6–0.7 | 600–750 |
| (c) | 20 ppm | 0.6–0.65 | 750–850 |
| (d) | 20 ppm | 0.35–0.4 | 450–550 |

It will be obvious to those skilled in the art that many modifications may be made within the scope of the present invention without departing from the spirit thereof, and the invention includes all such modifications.

What is claimed is:

1. An emulsion-breaking composition comprising about 70 to 99.8% by weight of at least one silicon-free demulsifier selected from the group consisting of I. reaction product of oxyalkylated phenol-formaldehyde resin with a dicarboxylic acid selected from the group consisting of saturated aliphatic dicarboxylic acids having 10 or less carbon atoms and benzene dicarboxylic acid, and II. reaction product of a block and mixed polymerizate of propylene oxide and ethylene oxide with a dicarboxylic acid selected from the group consisting of saturated aliphatic dicarboxylic acids having 10 or less carbon atoms and benzene dicarboxylic acid, and III. reaction product of a mixture of oxyalkylated phenolformaldehyde resin and block and mixed polymerizates of propylene oxide and ethylene oxide with a dicarboxylic acid selected from the group consisting of saturated aliphatic dicarboxylic acids having 10 or less carbon atoms and benzene dicarboxylic acid, and about 0.2 to 30% by weight of a mixed polyoxyalkylene-polysiloxane block polymerizate, the polyoxyalkylene blocks of which have a molecular weight of about 500 to 4000 and are composed of polyoxyethylene and polyoxypropylene blocks in a weight ratio of 40 to 60 to 100:0, and the polysiloxane blocks of which contain 3 to 50 silicon atoms per block.

2. A composition according to claim 1 in which the mixed polyoxyalkylene-polysiloxane block polymerizate is employed in a quantity of about 0.5 to 10% by weight.

3. A composition according to claim 1 in which the silicon-free demulsifier is employed in a quantity of about 90 to 99.5% by weight.

4. A composition according to claim 1 in which the polyoxyalkylene block has the formula $$[-O(C_nH_{2n}O)_m]_rZ$$

in which:

n is 2.0 to 2.6, m is a number such that the block molecular weight is between about 500 and 4000, Z is an alkyl or aryl residue of an alcohol, and r corresponds to the valence of the alcohol.

5. A composition according to claim 1 in which the polysiloxane block has the formula

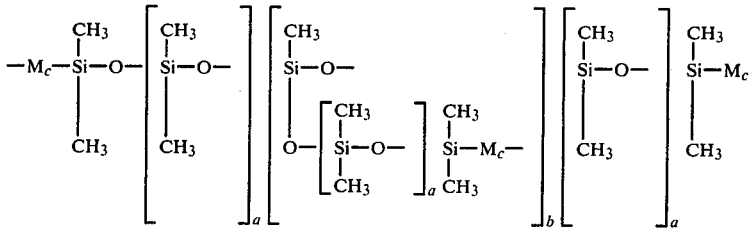

in which:

a and b are numbers such that the block contains 3 to 50 silicon atoms, c is 0 or 1, and M is an alkyl group.

6. A composition according to claim 1, in which the polysiloxane block has the formula

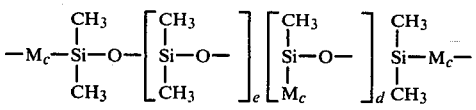

in which:

M is an alkyl group, c is 0 or 1, and d and e are numbers totaling 1 to 48.

7. A composition according to claim 1 in which the polysiloxane block has the formula

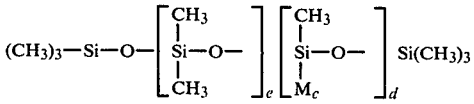

in which:

M is an alkyl group, c is 0 or 1, and d and e are numbers totaling 1 to 48, with d being at least 1.

8. An emulsion-breaking composition comprising about 70 to 99.8% of a silicon-free demulsifier wherein the demulsifier is a cross-linked product of a polypropylene glycol-ethylene oxide polyadduct and of a nonylphenol-formaldehyde resin reacted with an ethylene oxide, and about 0.2 to 30% by weight of a mixed polyoxyalkylene-polysiloxane block polymerizate of the HABAH formula, where

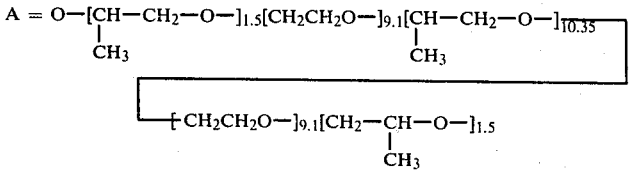

and

-continued

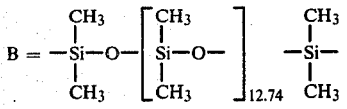

9. A process of breaking an emulsion which comprises mixing the emulsion with a composition comprising about 70 to 99.8% by weight of at least one silicon-free demulsifier selected from the group consisting of I. reaction product of oxyalkylated phenol-formaldehyde resin with a dicarboxylic acid selected from the group consisting of saturated aliphatic dicarboxylic acids having 10 or less carbon atoms and benzene dicarboxylic acid, and II. reaction product of a block and mixed polymerizate of propylene oxide and ethylene oxide with a dicarboxylic acid selected from the group consisting of saturated aliphatic dicarboxylic acids having 10 or less carbon atoms and benzene dicarboxylic acid, and III. reaction product of a mixture of oxyalkylated phenolformaldehyde resin and block and mixed polymerizates of propylene oxide and ethylene oxide with a dicarboxylic acid selected from the group consisting of saturated aliphatic dicarboxylic acids having 10 or less carbon atoms and benzene dicarboxylic acid, and about 0.2 to 30% by weight of a mixed polyoxyalkylene-polysiloxane block polymerizate, the polyoxyalkylene block of which have a molecular weight of about 500 to 4000 and are composed of polyoxyethylene and polyoxypropylene blocks in a weight ratio of 40 to 60 to 100:0, and the polysiloxane blocks of which contain 3 to 50 silicon atoms per block.

10. A process according to claim 9 in which the mixed polyoxyalkylene-polysiloxane block polymerizate is employed in a quantity of about 0.5 to 10% by weight.

11. A process according tp claim 9 in which the silicon-free demulsifier is employed in a quantity of about 90 to 99.5% by weight.

12. A process according to claim 9 in which the polyoxyalkylene block has the formula $$[-O(C_nH_{2n}O)_m]_r Z$$

in which:

n is 2.0 to 2.6, m is a number such that the block molecular weight is between about 500 and 4000, Z is an alkyl or aryl residue of an alcohol, and r corresponds to the valence of the alcohol.

13. A process according to claim 9 in which the polysiloxane block has the formula

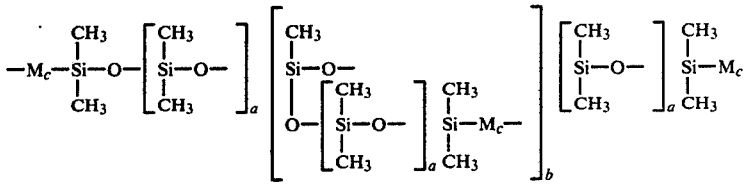

in which:

a and b are numbers such that the block contains 3 to 50 silicon atoms, c is 0 or 1, and M is an alkyl group.

14. A process according to claim 9 in which the polysiloxane block has the formula

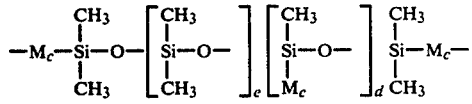

in which:

M is an alkyl group, c is 0 or 1, and d and e are numbers totaling 1 to 48.

15. A process according to claim 9 in which the polysiloxane block has the formula

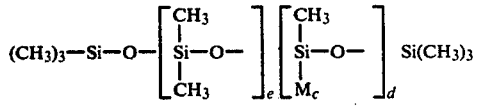

in which:

M is an alkyl group, c is 0 or 1, and d and e are numbers totaling 1 to 48, with d being at least 1.

* * * * *